US005731758A

United States Patent [19]

Suttlemyre et al.

[11] Patent Number: 5,731,758

[45] Date of Patent: Mar. 24, 1998

[54] TOILET WATER ECONOMIZER

[76] Inventors: Walter E. Suttlemyre, 3920 Crayton Rd., Naples, Fla. 34103; Vincent Albanese, 638 111th Ave. N., Naples, Fla. 34108

[21] Appl. No.: 848,894

[22] Filed: May 1, 1997

[51] Int. Cl.[6] ..... G08B 21/00

[52] U.S. Cl. ..... 340/612; 340/616; 340/620; 137/558; 73/304 R; 4/367

[58] Field of Search ..... 340/618, 620, 340/616, 612; 137/558, 392; 73/304 R; 4/367, DIG. 3

[56] References Cited

U.S. PATENT DOCUMENTS

| | | | |
|---|---|---|---|
| 3,874,403 | 4/1975 | Fischer | 137/392 |
| 3,944,845 | 3/1976 | Luteran | 340/620 |
| 3,987,502 | 10/1976 | Hartmann | 137/392 |
| 4,126,857 | 11/1978 | Lancia et al. | 340/620 |
| 4,203,173 | 5/1980 | Morris et al. | 137/392 |
| 4,297,686 | 10/1981 | Tom | 340/604 |
| 4,547,768 | 10/1985 | Kulhavy | 340/616 |
| 5,036,553 | 8/1991 | Sanderson | 4/313 |
| 5,188,143 | 2/1993 | Krebs | 137/312 |

*Primary Examiner*—Jeffery Hofsass
*Assistant Examiner*—Anh La
*Attorney, Agent, or Firm*—Merrill N. Johnson

[57] ABSTRACT

A toilet (6) has a solenoidal valve (1) in working relationship to a water-level probe (23), an overflow probe (25) and a floor-water probe (21) to prevent leaks reliably. A signal alarm (31) also is provided to warn of any problems and where they are in order to be able to repair them without the services of a professional plumber in many instances.

16 Claims, 1 Drawing Sheet

FIG. 1
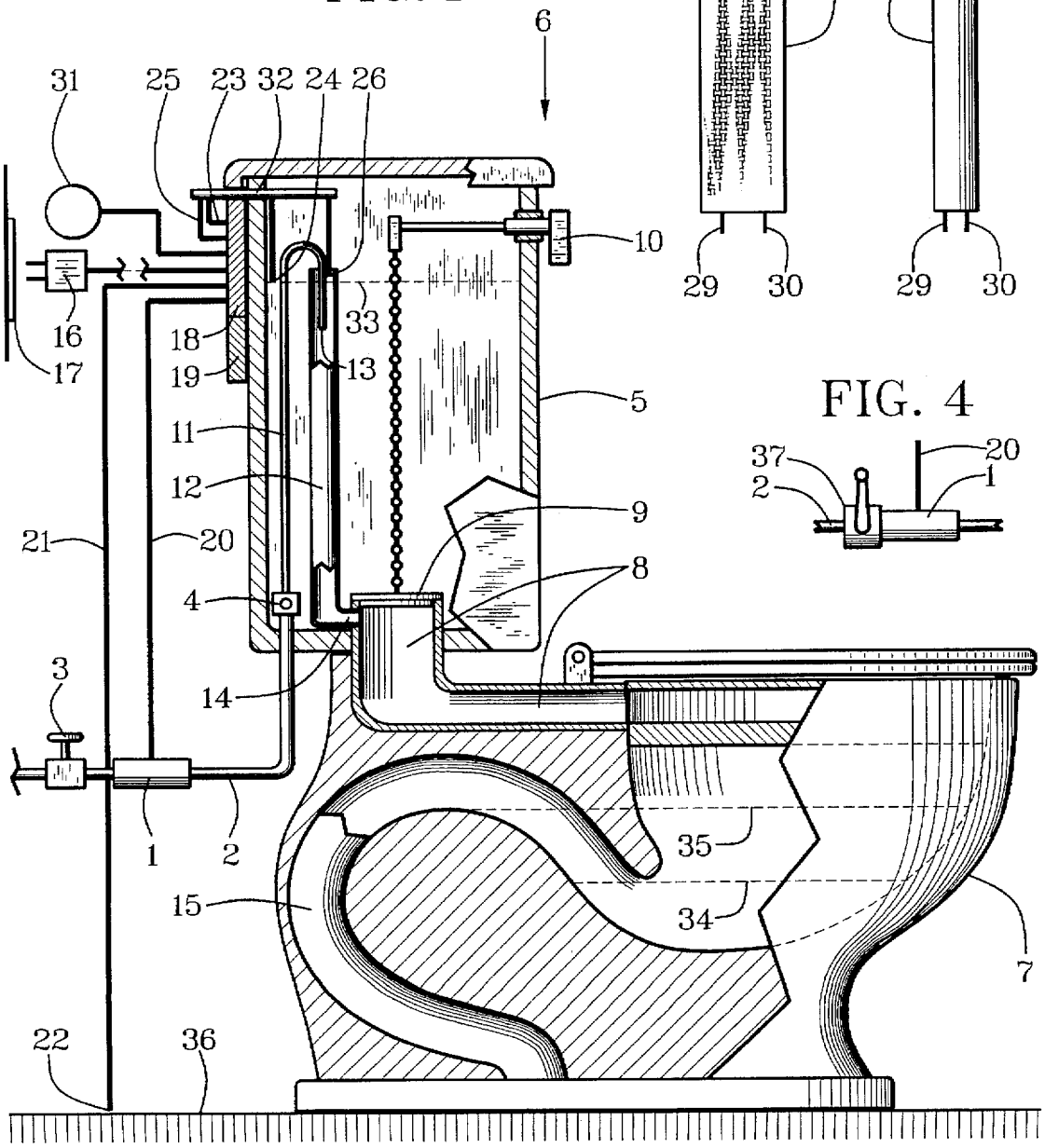
FIG. 2
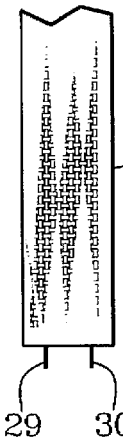
FIG. 3
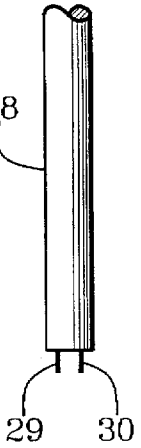
FIG. 4

TOILET WATER ECONOMIZER

BACKGROUND OF THE INVENTION

1. Field of the Invention

This invention relates to tank-type toilet flushers and in particular to solenoid valving of tank-filling water, overflow probes and leak probes electrically for saving water and plumber-service costs in relation to toilet sites.

2. Relation to Prior Art

Currently with the use of conventional toilet flushers, approximately one gallon of water is wasted each time a toilet is flushed. This waste results from flow through a water-inlet valve without flushing effect while flushing occurs. It is excess water that escapes into a tank before a water-inlet valve is closed mechanically. It is water that flows uselessly out a siphon trap.

In addition, water-inlet valves in toilet tanks can leak without detection and often waste large amounts water. Further yet, water from facilities near toilets in addition to water from toilet tanks and toilet-bowl overfill often can cause considerable water damage and waste.

Electrical probing devices have been provided previously for detecting water on surfaces near water facilities such as water heaters. None are known, however, to have working relationship to flushing toilets in a manner taught by this invention.

Examples of different but related devices are described in the following patent documents. U.S. Pat. No. 5,188,143, issued to Krebs, described an electronic probe positioned on a floor to operate an audible alarm in response to water on the floor. U.S. Pat. No. 4,297,686, issued to Tom, described a resistive liquid-detection and shut-off valve to protect a floor from water damage. U.S. Pat. No. 4,126,857, issued to Lancia et al taught a moisture detector that was particularly suitable for detecting moisture on and around electronic and electrical devices but had no working relationship to flushing a toilet.

SUMMARY OF THE INVENTION

In light of need for improvement of toilet flushers, objects of this invention are to provide a toilet water economizer which:

- Saves approximately one gallon of water each flush of a toilet;
- Detects water loss through leaking stopper valves;
- Eliminates pressured water in toilet tanks;
- Eliminates mechanical float valves in toilet tanks;
- Detects overflow water in overflow pipes of toilet-flushing systems;
- Detects water on a floor around a toilet from a flushing system and other sources;
- Has continuous battery backup power;
- Operates probes with alternating current to prevent build up of oxidizer on probe points; and
- Can eliminate need for approximately 80 percent of plumber services and water damage.

This invention accomplishes these and other objectives with a toilet water economizer having a solenoidal valve in a fill pipe from a water-supply valve to a tank inlet in a flush tank. The solenoidal valve is operable by current from a control box to which current is supplied through a transformer in electrical communication with a standard electrical line for a human-occupancy building. In electrical communication with the control box are a tank water-level probe, a water-overflow probe, a standby battery pack and, optionally a floor-water probe. The standby battery pack can be charged as needed by current from the transformer in order to supply current to the battery pack for operating the solenoidal valve and the probes during power failures at any time without battery changes.

The control box is structured and programmed to open and to close the solenoidal valve in response to water level in the flush tank, flow of water through an overflow pipe and existence of water on a floor. A tank-filling volume of water is released by the solenoidal valve to flow through the fill pipe to the flush tank after a delay that is timed to allow complete flushing of the toilet bowl with water released from the flush tank through a tank-outlet stopper valve. The timed delay prevents useless flow of water through the system when being operated. After being flushed, water is shut off at the solenoidal valve to prevent leaks through the system when not being operated.

BRIEF DESCRIPTION OF DRAWINGS

This invention is described by appended claims in relation to description of a preferred embodiment with reference to the following drawings which are described briefly as follows:

FIG. 1 is a partially cutaway elevation view showing a solenoidal valve and a selection of probes in relation to a control box and an alarm signal;

FIG. 2 is a sectional end view of a tape type of probe tip;

FIG. 3 is a sectional end view of a line type of probe tip; and

FIG. 4 is a sectional view of a solenoidal valve with a manual override.

DESCRIPTION OF PREFERRED EMBODIMENT

Reference is made first to FIGS. 1–3. A solenoidal valve 1 is employed in a fill pipe 2 that is in fluid communication from a water-supply valve 3 in the fill pipe 2 to a tank inlet 4 in a flush tank 5 for a toilet 6. A toilet bowl 7 is in fluid communication with the flush tank 5 through a tank outlet 8 having a stopper valve 9 that is operable by a flush handle 10. A siphon-fill pipe 11 is extended vertically from the tank inlet 4 to a position vertically above an overflow pipe 12 where it is then bent arcuately downward with a terminal siphon-fill end 13 inside of the overflow pipe 12. A base 14 of the overflow pipe 12 is extended from a bottom of the overflow pipe 12 to the tank outlet 8 at a position downstream fluidly from the stopper valve 9. A standard siphon trap 15 is employed to stop sewer odors. The solenoidal valve 1 replaces a conventional pressure valve at the tank inlet 4 as one aspect of this toilet water economizer in relationship to the toilet 6.

A transformer 16 in electrical communication with a standard electrical system, preferably through an electrical outlet 17, conveys current to a control box 18 through which pertinent plumbing features are controlled electrically for this toilet water economizer. Electrical current for the control box 18 can be backed up with a battery pack 19 having a battery that can be charged continuously as necessary to obviate need for changing batteries in order to provide operation during power outages.

In electrical communication with the control box 18 are the solenoidal valve 1 through a valve line 20, a floor-water probe 21 with a water-probe end 22, a water-level probe 23 with a level-probe end 24, and an overflow probe 25 with an overflow-probe end 26. The probes can be a conventional tape type 27 depicted in FIG. 2 or a conventional line type 28 depicted in FIG. 3. Either have a positive pole 29 and a negative pole 30 that may or may not protrude visibly from terminal ends of the probes.

Positive current from the control box 18 is directed to a positive pole 29 but does not have an open circuit for return flow of current unless a conductive medium such as water exists for electrical communication between the positive pole 29 and the negative pole 30. Return flow of current from the negative pole 30 provides the control box 18 with a signal current that can be employed in accordance with design of the control box 18 for operating the solenoidal valve 1 and/or a signal alarm 31.

A line conduit 32 can be employed optionally to contain the water-level probe 23 and the overflow probe 25 intermediate the control box 18 and an internal portion of the flush tank 5.

The level-probe end 23 of the water-level probe 23 detects water at a tank-full level 33 and shuts off the solenoidal valve 1. The siphon-fill pipe 11 provides water designedly slow between a flushed level 34 and a ready level 35 to avoid siphon effect when rapid flow would drain waste-containment water from the toilet bowl 7 and decrease odor-trapping effect. The overflow-probe end 26 is positioned vertically above the siphon-fill end 13 of the siphon-fill pipe 11 in order to avoid flow of water at the overflow-probe end 26 after flushes when the toilet bowl 7 is being filled from the flushed level 34 to the ready level 35. In the event that the water-probe end 22 of the floor-water probe 21 detects water on a floor 36, the control box 18 shuts off the solenoidal valve 1 and/or causes an alarm signal by the signal alarm 31.

In addition to saving a gallon of water repeatedly by appropriate timing of tank filling with the solenoidal valve 1, plumber costs can be saved by programming the control box 18 to provide different signals through the signal alarm 31 for different probes 22, 23 and 25 to communicate nature and location of problems that might occur.

The control box 18, the battery pack 19 and the signal alarm 31 can be positioned wherever desired in relation to a toilet 6. In practice, the control box 18 in particular can be much smaller in proportion to the toilet 6 and other components than shown for patent illustration. The battery pack 19 also can be proportionally smaller. Either or both can be hung with hooks on top of an outside of a wall of a flush tank 5 for ease of installation if desired. The signal alarm 31 also can be hung with them or positioned wherever else desired. The transformer 16 can be plugged into a shaving outlet or other electrical outlet in a bathroom. The probes, 22, 23 and 25, can be placed on top of a wall of a flush tank 5 with small nibs to hold a lid off of them if desired for aftermarket installation. Adaptation of this invention is quite easy.

Referring to FIG. 4, a manual override 37 of the solenoidal valve 1 can be provided. It is particularly useful for emergency and repair conditions when a person might want to turn the solenoidal valve 1 off and on at will. This can be accomplished also with control box 18 that can be programmed to maintain the solenoidal valve 1 in an open position on demand in order to allow use of the water-supply valve 3 during repairs and emergencies.

A new and useful toilet water economizer having been described, all such foreseeable modifications, adaptations, substitutions of equivalents, mathematical possibilities of combinations of parts, pluralities of parts, applications and forms thereof as described by the following claims and not precluded by prior art are included in this invention.

I claim:

1. A toilet water economizer comprising:

a solenoidal valve in a fill pipe that is in fluid communication from the fill pipe to a tank inlet of a flush tank for a toilet;

a toilet bowl in fluid communication with the flush tank through a tank outlet having a stopper valve that is operable by a flush handle;

a transformer in electrical communication with a standard electrical system of a human-occupancy building;

a control box in electrical communication with the transformer;

a water-level probe having a level-probe end that is positioned internally from side walls of the flush tank at a select elevation in relation to a bottom of the flush tank for determining existence of water at the level-probe end;

the water-level probe being in electrical communication with the control box for communication of existence of water at the level-probe end to the control box;

an overflow probe having an overflow-probe end that is positioned in an overflow pipe of a flush tank to detect overflow of water from a level of water vertically above a top of the overflow pipe to the toilet bowl;

the overflow probe being in electrical communication with the control box for communication of existence of water overflowing from the flush tank to the toilet bowl through the overflow pipe;

the control box being structured and programmed electronically to cause opening of the solenoidal valve at a fixable time after flushing the toilet to allow releasing of water into the toilet bowl from the flush tank;

the control box being structured and programmed electronically to cause closing of the solenoidal valve in response to detection of water at a level in the flush tank that is at or above the water-level probe and near a top of the overflow pipe;

the control box being structured and programmed electronically to cause closing of the solenoidal valve in response to detection of water in the overflow pipe; and the control box being structured and programmed electronically to cause an alarm signal in event of water being detected beyond at least one probe terminal.

2. A toilet water economizer as described in claim 1 and further comprising:

a floor-water probe in electrical communication with the control box;

the floor-water probe having a water-probe end that is positioned immediately above a top surface of a floor in proximity to the toilet bowl; and the control box being structured and programmed electronically to cause an alarm signal in event of water being detected by the floor-water probe on the top surface of the floor.

3. A toilet Water economizer as described in claim 1 wherein:

flushing of the toilet is communicated to the control box from the water-level probe by disappearance of water at the probe end of the water-level probe.

4. A toilet water economizer as described in claim 1 wherein:

the fixable time after flushing the toilet is a plurality of seconds between a minimum of about five seconds and a maximum of about fifteen seconds.

5. A toilet water economizer as described in claim 1 wherein:

the fixable time after flushing the toilet is approximately eight seconds.

6. A toilet water economizer as described in claim 1 and further comprising:

a manual override of the solenoidal valve.

7. A toilet water economizer as described in claim 1 wherein:

the alarm signal is clicking of the solenoidal valve between open and closed positions.

8. A toilet water economizer as described in claim 1 wherein:

the alarm signal is an audio device.

9. A toilet water economizer as described in claim 1 and further comprising:

a siphon-fill conveyance in fluid communication from the tank inlet to the toilet bowl;

the siphon-fill conveyance has a conveyance capacity with such a proportionally smaller conveyance capacity than the fill pipe to the tank inlet that water conveyed to the toilet bowl by the siphon-fill conveyance fills the toilet bowl to proximate a level that causes gravitational flow of water through a siphon trap of a toilet bowl during a period of time that flow of water into the flush tank through the fill pipe to the tank inlet fills the flush tank to the level-probe end of the water-level probe.

10. A toilet water economizer as described in claim 9 wherein:

the siphon-fill conveyance is a siphon-fill pipe extended vertically from the tank inlet to a position vertically above the overflow pipe, then curved arcuately downward and extended to a position inside of the overflow pipe where the siphon-fill pipe is extended further yet to a siphon-fill terminal end that is vertically below the overflow-probe end of the overflow probe.

11. A toilet water economizer as described in claim 1 and further comprising:

a leakage alarm in communication with the control box; and the control box is structured and programmed electronically to cause actuation of the leakage alarm in event of water at a probe end of a probe that is in electrical communication with the control box.

12. A toilet water economizer as described in claim 11 wherein:

the leakage alarm is an audio device.

13. A toilet water economizer as described in claim 1 wherein:

electrical current from the control box to the water-level probe and to the overflow probe is alternating current.

14. A toilet water economizer comprising:

a solenoidal valve in a fill pipe that is in fluid communication from a water-supply valve to a tank inlet of a flush tank for a toilet;

a toilet bowl in fluid communication with the flush tank through a tank outlet having a stopper valve that is operable by a flush handle;

a transformer in electrical communication with a standard electrical system of a human-occupancy building;

a control box in electrical communication with the transformer;

a water-level probe having a level-probe end that is positioned internally from side walls of the flush tank at an elevation in relation to a bottom of the flush tank for determining existence of water at the level-probe end;

the water-level probe being in electrical communication with the control box for communication of existence of water at the level-probe end to the control box;

an overflow probe having an overflow-probe end that is positioned in an overflow pipe of a flush tank to detect overflow of water from a level of water vertically above a top of the overflow pipe to the toilet bowl;

the overflow probe being in electrical communication with the control box for communication of existence of water overflowing from the flush tank to the toilet bowl through the overflow pipe;

the control box being structured and programmed electronically to cause opening of the solenoidal valve at a fixable time after flushing the toilet and releasing of water into the toilet bowl from the flush tank;

the control box being structured and programmed electronically to cause closing of the solenoidal valve in response to detection of water at a level in the flush tank that is at the water-level probe and near a top of the overflow pipe;

the control box being structured and programmed electronically to cause an alarm signal in event of water being detected in the overflow pipe;

a floor-water probe in electrical communication with the control box;

the floor-water probe having a water-probe end that is positioned immediately above a top surface of a floor in proximity to the toilet bowl;

the control box being structured and programmed electronically to cause an alarm signal in event of water being detected by the floor-water probe;

flushing of the toilet is communicated to the control box from the water-level probe by nonexistence of water at the probe end of the water-level probe; and the fixable time after flushing the toilet is a plurality of seconds between a minimum of about five seconds and a maximum of about fifteen seconds.

15. A toilet water economizer as described in claim 14 and further comprising:

a manual override of the solenoidal valve;

a siphon-fill conveyance in fluid communication from the tank inlet to the toilet bowl; and the siphon-fill conveyance has a conveyance capacity with such a proportionally smaller conveyance capacity than the fill pipe to the tank inlet that water conveyed to the toilet bowl by the siphon-fill conveyance fills the toilet bowl to proximate a level that causes gravitational flow of water through a siphon trap of a toilet bowl during a period of time that flow of water into the flush tank through the fill pipe to the tank inlet fills the flush tank to the level-probe end of the water-level probe simultaneously.

16. A toilet water economizer as described in claim 15 wherein:

electrical current from the control box to the water-level probe, to the overflow probe and to the floor-water probe is alternating current.

* * * * *